US007053784B2

(12) United States Patent
Hatfield et al.

(10) Patent No.: US 7,053,784 B2
(45) Date of Patent: May 30, 2006

(54) SYSTEM AND METHOD FOR MONITORING ALIGNMENT OF A SIGNAL LAMP

(75) Inventors: William Thomas Hatfield, Schenectady, NY (US); Kenneth Brakeley Welles, II, Scotia, NY (US); Harry Kirk Mathews, Jr., Clifton Park, NY (US); Emad Andarawis Andarawis, Ballston Lake, NY (US); David Michael Davenport, Niskayuna, NY (US); Dennis Dominic Cusano, Scotia, NY (US); Ganesh Chandan Gangadharan, Karnataka (IN); Ertugrul Berkcan, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 10/832,002

(22) Filed: Apr. 23, 2004

(65) Prior Publication Data

US 2005/0237215 A1 Oct. 27, 2005

(51) Int. Cl.
*G08B 21/00* (2006.01)

(52) U.S. Cl. ..... 340/686.1; 340/686.2; 340/690; 340/907; 200/61.45 R; 200/61.52; 356/138

(58) Field of Classification Search ..... 340/686.1, 340/686.2, 690, 907, 908, 908.1, 931; 200/61.45 R, 200/61.52; 73/652; 459/484, 485, 515, 459/107, 341.5; 356/138
See application file for complete search history.

(56) References Cited

U.S. PATENT DOCUMENTS

| | | | | |
|---|---|---|---|---|
| 5,512,905 | A * | 4/1996 | Nichols et al. | 342/357.06 |
| 5,556,070 | A | 9/1996 | Viebrock | |
| 6,222,446 | B1 | 4/2001 | Hilleary | |
| 6,305,602 | B1 * | 10/2001 | Grabowski et al. | 235/379 |
| 6,369,704 | B1 | 4/2002 | Hilleary | |
| 6,437,517 | B1 * | 8/2002 | Kramer | 315/246 |

* cited by examiner

*Primary Examiner*—Davetta W. Goins
(74) *Attorney, Agent, or Firm*—Paul J. DiConza; Patrick K. Patnode

(57) ABSTRACT

A system for monitoring alignment of a signal lamp includes at least one sensor and threshold detection circuitry. The sensor is positioned about the signal lamp and is configured to measure at least one of azimuthal and elevational movement of the signal lamp and generate an electrical signal. The threshold detection circuitry is configured to receive signals representative of the azimuthal and elevational movement of the signal lamp from the sensor. The threshold detection circuitry determine a change in alignment of the signal lamp according to at least one of the azimuthal movement signals and the elevational movement signals.

37 Claims, 5 Drawing Sheets

SYSTEM AND METHOD FOR MONITORING ALIGNMENT OF A SIGNAL LAMP

BACKGROUND OF THE INVENTION

The present invention generally relates to signal lamps and more particularly to a system and method for monitoring alignment of a signal lamp.

Signal lamps are a common means of warning and controlling approaching traffic at a highway-rail grade crossing or road-road crossing. A typical signal lamp utilizes alternating flashing lamps to warn oncoming traffic of an approaching vehicle or a train. When properly aligned, the flashing lamps are highly visible to motorists approaching the crossing. If the lamps are misaligned, then they may not be seen until it is too late to avoid a dangerous situation.

Usually a signal lamp unit is inspected when installed and then periodically for proper alignment and frequency of flashes in accordance with installation specifications. Currently, signal lamps are inspected for alignment by sending a signal lamp maintainer out to each site and manually checking the alignment of each lamp. A problem with manually inspecting the alignment of the signal lamps is the cost involved with performing the inspection. In particular, it is expensive to send a maintainer out to the many sites to do an inspection on a yearly or monthly basis. Moreover, the response time to correct a misaligned lamp is limited by the frequency of manual inspection or notification by passing motorists. Another problem is that of human error with maintenance of signal alignment with the roadway.

In order to overcome the above-mentioned problems, there is a need for an approach that can automate the inspection of the signal lamps for alignment from a remote site. The ability to remotely monitor alignment would likely improve safety since the signal lamps could be inspected on a more periodic basis as opposed to once a month or year. As a result, alignment problems could be reported as they occur and fixed very soon thereafter. Costs, time and effort associated with inspecting the alignment of the signal lamps would likely decrease because maintainers would not have to go to each crossing site to inspect alignment; only to the ones that were noted as misaligned.

BRIEF DESCRIPTION OF THE INVENTION

Briefly, in accordance with one embodiment of the present invention, there is provided a system for monitoring alignment of a signal lamp. In this embodiment, the system comprises at least one sensor and threshold detection circuitry. The sensor is positioned about the signal lamp and is configured to measure at least one of azimuthal and elevational movement of the signal lamp and generate an electrical signal. The threshold detection circuitry are configured to receive signals representative of the azimuthal and elevational movement of the signal lamp from the sensor and the circuitry determine a change in alignment of the signal lamp according to at least one of the azimuthal movement signals and the elevational movement signals.

In accordance with another embodiment of the invention, a method is provided for monitoring alignment of a signal lamp. The method comprises positioning at least one sensor about the signal lamp and configuring the sensor to measure at least one of azimuthal and elevational movement of the signal lamp. The method further comprises receiving at least one of signals representative of the azimuthal and elevational movement of the signal lamp from the sensor and determining a change in alignment of the signal lamp according to the signal representative of at least one of the azimuthal and the elevational movement of the signal lamp.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
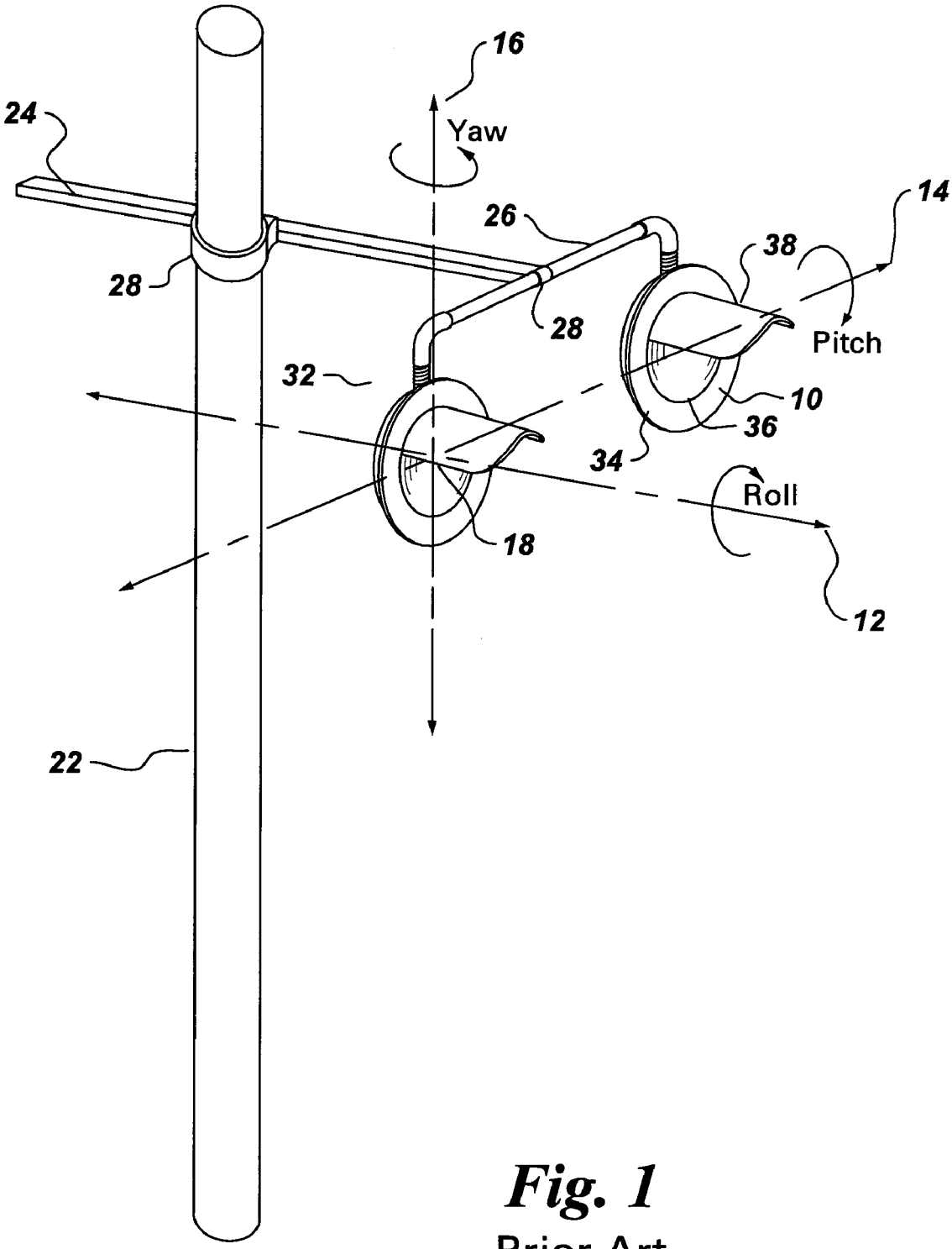
Fig. 1 Prior Art
FIG. 1 illustrates a perspective view of a common signal lamp and possible axes of its movement as in the prior art.

FIG. 1 illustrates a common signal lamp 10 that is in place in many highway-rail grade crossings or road-road crossings. Although the present invention is described with reference to a signal lamp found at a highway-rail grade crossing, the principles of the invention are not limited to such signal lamps. One of ordinary skill will recognize the invention is suited for other types of signal lamps such as traffic signal lamps composed of a plurality of lamps each having a single color or symbol that are generally installed at intersection approaches in order to control the flow of automobiles and pedestrians.

In addition to showing the signal lamp, FIG. 1 illustrates the lamp's supporting structure and all its possible axes of movement. The supporting structure comprises a vertical mast 22, a horizontal bar 24, horizontal arms 26 and a coupling fixture 32. The horizontal bar 24 is fixed to the mast 22 by means of an interlocking mechanism 28. The horizontal arms 26 and the coupling fixture 32 are fixed to horizontal bar 24 by means of another interlocking mechanism such as bolts 28. It is assumed that in an ordinary situation the supporting structure is unlikely to move. The signal lamp 10 hangs from the coupling fixture 32 and is fixed to it by means of a fixture 32. Fixture 32 is typically a right angle pipe coupler with circular cross section. Such a coupling fixture 32 consists of a u-shaped bolt for fixture to horizontal arms 26 on one end and a threaded opening with tightening bolt on the other end for fixture to the signal lamp 10. The signal lamp 10 comprises a frame 34, a lens 36 and a hood 38. The signal lamp 10 also comprises an internal light source that is either an incandescent bulb or LED array. This light source is not shown in FIG. 1. There are three mutually perpendicular axes of movement of the signal lamp 10—roll, pitch and yaw. The roll axis 12 represents an axis that runs horizontally through the center 18 of the face of the signal lamp 10 and is normal to the face of the signal lamp 10. The pitch axis 14 represents an axis that lies on the plane of the face of the signal lamp 10 and runs horizontally through the center 18 of the face of the signal lamp 10. The yaw axis 16 represents an axis that is normal to both roll axis 12 and pitch axis 14 and runs vertically through the center 18 of the face of the signal lamp 10.

All movements of the signal lamp 10 are relative to the supporting structure. The signal lamp 10 is capable of movement about its pitch (horizontal) axis 14, which would cause the signal lamp 10 to tilt up or down in an elevational plane. The signal lamp 10 can also move about its yaw (vertical) axis 16 that would cause the signal lamp 10 to move from side to side on an azimuthal plane. These are the two primary movements to be sensed for determining if the signal lamp is misaligned. There can be yet another movement which is a combination of the two primary movements. In a rare event, if the mast is struck hard enough to move the mast, it will cause the signal lamp 10 to appear to move in azimuth and/or elevation. The first movement is about the yaw axis 16 and the other movement is about the pitch axis 14. Movement about the roll axis 12 is a secondary movement and it would occur only if the mast 22 holding the signal lamp 10 were bent as in a car crash or tilted as in a shift of its foundation by earthquake.

Movements of the signal lamp 10 in azimuth and elevation are further grouped in two categories—small movements that occur over a long period of time and large movements that occur almost instantaneously. Small movements occurring over time are most likely the result of environmental effects such as vibration and/or wind-induced oscillations. Such effects will most likely cause the signal lamp to move by a few degrees over a long period of time. Gross movements that occur over a short period of time are most likely caused when the signal lamp 10 is moved intentionally by an unauthorized person or as the result of an accident (e.g. a vehicle striking the mast on which the signal lamp is mounted). Another possible source of gross movement is due to installation deficiencies, failure of the installer/maintainer to properly tighten the fixtures after installation or adjustment etc.

Current warning lamp installation practices and equipment, however, allow a signal lamp only limited freedom to move in either azimuth or elevation. Such movement may cause a lamp's illumination pattern to shift and may result in decreased visibility of the warning lamp from the approach roadway. Based on analysis of recommendations of the American Railway Engineering and Maintenance of Way Association (AREMA) defined in their 2004 Communication and Signaling Manual section 3.2.35, a movement in azimuth or elevation of less than 4.5 degrees will still maintain illumination 1000 feet down the roadway. Thus, there is a need to reliably determine if the signal lamp has moved more than about plus or minus 4.5 degrees from its original alignment position on an azimuthal plane or on an elevational plane.

In the invention, the movements of the signal lamp 10 are measured on an elevational plane and an azimuthal plane. There are two references useful for measuring movement of a signal lamp in azimuth and elevation—magnetic field (artificially generated by a permanent magnet or an electromagnet or the natural magnetic field of the earth) and gravitation. With a magnetic field as a reference and any magnetic field sensor such as a giant magneto resistive (GMR) sensor, it is possible to determine if the signal lamp 10 has moved on an azimuthal plane or an elevational plane. Similarly, a tilt sensor such as an accelerometer affixed to the signal lamp 10 can sense changes in elevation. If the supporting structure of the signal lamp 10 were tilted so that it was at an angle to the vertical, the accelerometer placed in the supporting structure could sense movement in both azimuth and elevation.

Figure 2:
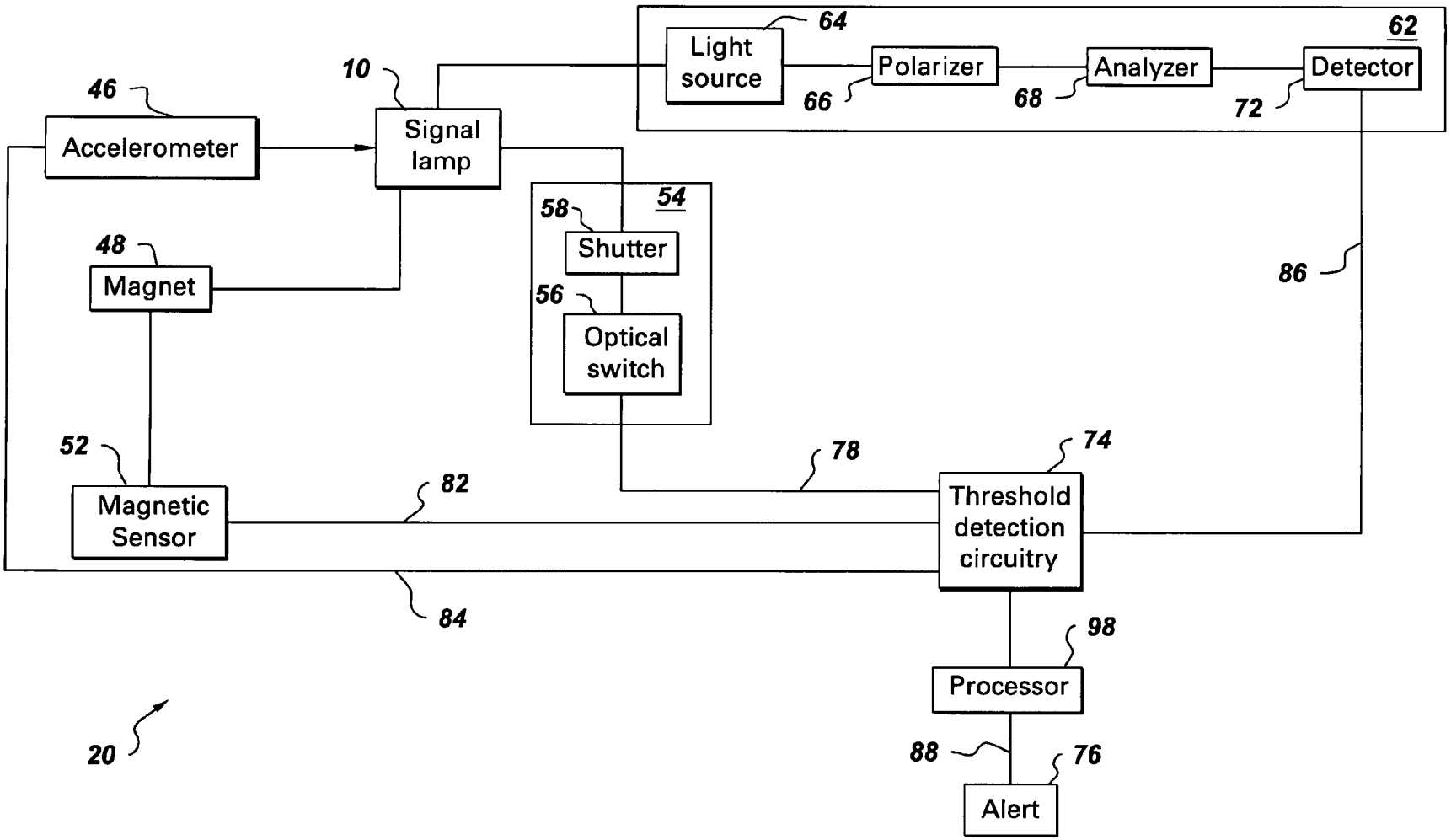
FIG. 2 illustrates a block diagram of one embodiment of the invention that measures elevational movement of a signal lamp using an accelerometer and azimuthal or elevational movement of the signal lamp using a magnet, a magnetic sensor, an optical sensor assembly and a shutter assembly.

FIG. 2 illustrates a block diagram of system 20 that measures both elevational and azimuthal movements of the signal lamp 10 according to one embodiment of the invention. In this embodiment, elevational movement is measured using an accelerometer 46. The accelerometer 46 is attached to the signal lamp 10 and any movement of the signal lamp 10 on an elevational plane and about its pitch axis will make the accelerometer 46 move by the same angle. In this embodiment, the accelerometer 46 is a two-axis accelerometer. A typical two-axis accelerometer such as Analog Device's ADXL311 MEMS, two-axis accelerometer, is a surface micro machined structure built on top of a silicon wafer. The structure contains two sensors that have their axes of sensitivity at 90 degrees with respect to each other. Therefore, each one is sensitive only to acceleration along its axis of sensitivity. Springs suspend the structure over the surface of the wafer and provide a resistance against acceleration forces. Deflection of the structure is measured using a differential capacitor that consists of independent fixed plates and central plates attached to the moving mass. The fixed plates are driven by square waves that are 180 degrees out of phase. Force of gravity deflects the beam and sets an imbalance in the differential capacitor, resulting in an output square wave whose amplitude is proportional to acceleration. The square wave is then demodulated, and the result is amplified, and brought off chip. Although the accelerometer 46 is described as a two-axis accelerometer, one of ordinary skill in the art will recognize that other types of accelerometers such as one-axis accelerometers are also suitable for use in this invention. Use of a two-axis accelerometer allows for its alignment and sensing of angular displacement relative to pitch as well as roll axes. As discussed above, movement in roll axes is indicative of movement of vertical mast 22.

In FIG. 2, any change in position of the accelerometer 46 is sensed by threshold detection circuitry 74. The accelerometer 46 output changes in magnitude based on the cosine of the tilt angle between the accelerometer axes and the gravity vector. The accelerometer 46 outputs a signal representative of the vertical tilt of the signal lamp 10. The accelerometer 46 is electrically coupled to the threshold detection circuitry 74 and its output signal is transmitted to the threshold detection circuitry 74 via electrical line 84.

The threshold detection circuitry 74 make an analog device that is in communication with an input device. For instance, the input device in this embodiment is the accelerometer 46. There is a predetermined reference value of control voltage configured as the threshold for reference. The threshold detection circuitry 74 are configured to compare an output of the input device with the predetermined threshold and determine whether the direct current signal output of the input device exceeds the predetermined reference value. In particular, the threshold detection circuitry 74 convert the direct current (0 Hz) output of the accelerometer 46 into a measure of the angular displacement of the accelerometer 46 in relation to its original position. That is also the angle by which the signal lamp 10 has moved in elevation.

In case the threshold is exceeded and the signal lamp 10 is sensed to have moved by more than the acceptable limit (such as 4.5 degrees) the threshold detection circuitry 74 send a signal to a processor 98. Processor 98 in turn processes the information coming from the threshold detection circuitry 74 and sends a signal to an alerting system 76. The processor 98 is a microprocessor unit and it is programmed with appropriate software, to interpret the output signal of the threshold detection circuitry 74. The processor 98 sends an alarm signal via the electrical line 88 to the alerting system 76 and the alerting system 76 generates an appropriate alarm to a remote location.

Azimuthal movement of the signal lamp 10 is measured in this embodiment by using a magnet 48, a magnetic sensor 52, a shutter assembly 54 and an optical sensor assembly 62. In addition, the magnetic sensor 52, shutter assembly 54 and the optical sensor assembly 62 can also be used to measure elevational movement of the signal lamp. The magnet 48 is not connected to the signal lamp 10, but instead is affixed mechanically on the coupling fixture 32 of the signal lamp 10 in such a way that it does not move even if the signal lamp moves in any direction. The magnetic sensor 52 is positioned above the hood of the signal lamp 10 in such a way that it is affixed to the signal lamp frame 34 and any movement of the signal lamp 10 in any direction will cause the magnetic sensor 52 also to move in the same direction. With this implementation, the magnetic sensor 52 can measure azimuthal and elevational movement of the signal lamp 10. In this embodiment, the magnet 48 is a permanent magnet, while the magnetic sensor 52 is a giant magneto resistive (GMR) sensor.

The GMR sensor 52 is commercially available as an integrated circuit package and it is sensitive in the plane of the package. The GMR sensor 52 is a thin-film magnetic device that is small, requires little power, and can be easily combined with other electronics. Usually GMR sensor 52 exhibits a large change in resistance in response to a magnetic field. This property distinguishes the GMR sensor 52 from any other conventional anisotropic magneto resistance (AMR) material. Whereas an AMR resistor exhibits a change of resistance less than 3%, the GMR material used in this invention achieves a change in resistance ranging between 10% and 20%. In operation, GMR sensor 52 has two or more magnetic layers separated by a nonmagnetic layer. Because of spin-dependent scattering of the conduction electrons, the resistance is maximum when the magnetic moments of the layers are antiparallel, and minimum when they are parallel.

The use of the GMR as a magnetic sensor is based on the well-known Hall effect. According to the Hall effect, if a magnetic field is applied along a z-axis to a bar that carries a current along an x-axis, an electric field is produced along a y-axis. The electric field is proportional to the strength of the magnetic field and the current density. The electric field can be sensed and used to determine the magnitude of the magnetic field or at least to determine when there is a significant change in the magnetic field.

In operation, the GMR sensor material is usually patterned into narrow stripes a few microns wide. The magnetic field generated by a current of a few milliamperes per micron of stripe width flowing along the stripe is sufficient to rotate the magnetic layers into antiparallel or high-resistance alignment. An external magnetic field applied along the length of the stripe can overcome the field from the current as well as any magnetic interaction between the layers and rotate the magnetic moments of both layers parallel to the external field, reducing the resistance. A positive or negative external field parallel to the stripe will produce the same change in resistance. An external field applied perpendicular to the stripe will have little effect due to the demagnetizing fields associated with the extremely narrow dimensions of the magnetic objects. Therefore, these stripes effectively respond to the component of magnetic field along their length. In particular, the GMR sensor 52 possesses a characteristic axis of sensitivity. The output voltage varies with the cosine of an angle between the external magnetic field of the magnet 48 and the axis of sensitivity of the GMR sensor 52. The angle is taken in the plane of the integrated circuit package pins. For instance, the sensitivity of an AA004 GMR sensor is specified over the range of 0.9 to 1.3 mV (output) per Oe per Volt (supply).

In another embodiment of this invention, the magnetic sensor 52 may comprise a pair of GMR sensors. In particular, two GMR sensors are used to get a differential measure of the change in position of the signal lamp on an azimuthal plane. The integrated circuit packages containing the GMR sensors and the local magnet 48 are installed with proper fixtures. The sensor packages are aligned next in such a way that the magnet 48 is centered between the GMR pair and at equal distances from each GMR sensor. This is to ensure that the magnetic field strength is equal at the two locations of the two GMR sensors.

In one embodiment with two GMR sensors, the differential value measured is the simple difference between the sensor outputs. In another embodiment, the differential output values from the two GMR sensors are observed and a normalized difference is recorded as the baseline value. The normalized difference is the ratio of the simple difference between the sensor outputs to the total of the two sensor outputs. Use of this metric ensures that any part-to-part variation between the two sensors as well as any error from the change of the strength of the magnet from time to time are accounted for and eliminated. Change in normalized differential output values as compared to the baseline value are monitored so that standard thresholds are not exceeded. Such an approach uses linear sensor response and allows for manual alignment of the local magnet with GMR sensor pair to about a given threshold (such as about plus or minus 4.5 degrees).

The invention is not limited to the above-described GMR. Any low magnetic field sensing or field gradient sensing sensor can be used. However, solid-state magnetic field sensors have an inherent advantage in size and power consumption when compared with search coil, flux gate, and more complicated low-field sensing techniques (e.g., superconducting quantum interference detectors [SQUID] and spin resonance magnetometers). For instance, solid-state magnetic sensors like spin dependent tunneling (SDT), spin valve, etc. convert the magnetic field into a voltage or resistance. The sensing can be done in an extremely small, lithographically patterned area, further reducing size and power requirements. The small size of a solid-state element increases the resolution for fields that change over small distances and allows for packaging arrays of sensors in a small enclosure.

The invention is also not limited to the magnetic field of a local magnet. In another embodiment, the magnetic field of earth can be used as reference. In another embodiment, the magnetic field generated from more than one magnet can be used as reference. In another embodiment, the plane of measurement for the movement of the signal lamp could be any one or two of an elevational plane and an azimuthal plane.

In operation, the magnetic sensor 52 is affixed to the signal lamp 10 and the threshold detection circuitry 74 detect any change in position of the magnetic sensor 52. In this embodiment, the magnetic sensor 52 outputs a signal representative of the azimuthal shift of the signal lamp and sends the signal to the threshold detection circuitry 74 via electrical line 82. The threshold detection circuitry 74 make an analog device that determines whether a preset threshold value of magnetic energy is exceeded or not depending on the output signal from the magnetic sensor 52. In particular, the threshold detection circuitry 74 convert the output of the magnetic sensor 52 into a measure of the angular displacement of the magnetic sensor 52 in relation to its original position. That is also the angle by which the signal lamp 10 has moved.

In case the threshold is exceeded and the signal lamp 10 is sensed to have moved by more than the acceptable limit (such as 4.5 degrees), the threshold detection circuitry 74 send a signal to the processor 98. Processor 98 in turn processes the information coming from the threshold detection circuitry 74 and sends a signal to an alerting system 76. The processor 98 is a microprocessor unit and it is programmed with appropriate software, to interpret the output signal of the threshold detection circuitry 74. The processor 98 sends an alarm signal via the electrical line 88 to the alerting system 76 and the alerting system 76 generates an appropriate alarm to a remote location.

The illustrated embodiment of FIG. 2 also comprises a shutter assembly 54 positioned about the signal lamp 10. The shutter assembly 54 is affixed to the coupling fixture 32 of the signal lamp 10 and it is configured to measure azimuthal or elevational movement of the signal lamp 10. The shutter assembly 54 has an optical switch 56 and a shutter 58 located at a predetermined distance from the optical switch 56. The shutter 58 is capable of closing an aperture of 5 mm at a maximum speed of 1.7 mm/ms with a timing jitter of less than 10 μs. The shutter assembly is connected to the threshold detection circuitry 74 by means of an electrical line 78. The optical switch 56 provides either an analog or digital output level related to the amount of light passing through the optical switch. The Fairchild Semiconductor optical interrupter switch H21A3 can be used for element 56.

In operation, the stationary shutter 58 is initially arranged in such a way that it is aligned with the signal lamp 10. Movement of the signal lamp 10 results in movement of the shutter 58. At that time, if the aperture opens, a beam of light can come in. This light is sensed by a photosensitive cell and a voltage is generated as a result depending on the intensity of the light sensed. A current signal is passed to the threshold detection circuitry 74 at that instant via the electric line 78. In an alternative situation, if the signal lamp 10 moves, the shutter moves into a position which interrupts the optical switch 56 reducing the aperture leading to reduced or no light level sensed. In that case, threshold detection circuitry 74 receive a signal via the electric line 78 indicating reduced light or they do not receive any signal meaning no light is being sensed.

In operation, the shutter 58 is affixed to the signal lamp 10 and the threshold detection circuitry 74 detect any change in position of the shutter 58 by monitoring the output of optical switch 56. In this embodiment, the optical switch 56 outputs a signal representative of the azimuthal shift of the signal lamp and sends the signal to the threshold detection circuitry 74 via electrical line 78. In another embodiment, the optical switch 56 outputs a signal representative of the elevational shift of the signal lamp and sends the signal to the threshold detection circuitry 74 via electrical line 78. The threshold detection circuitry 74 make an analog device that determines whether a preset threshold value of light energy is exceeded or not depending on the output signal from the optical switch 56. In particular, the threshold detection circuitry 74 convert the output of the optical switch 56 into a measure of the angular displacement of the shutter 58 in relation to its original position. That is also the angle by which the signal lamp 10 has moved.

In case the threshold is exceeded and the signal lamp 10 is sensed to have moved by more than the acceptable limit (such as 4.5 degrees), the threshold detection circuitry 74 send a signal to the processor 98. Processor 98 in turn processes the information coming from the threshold detection circuitry 74 and sends a signal to an alerting system 76. The processor 98 is a microprocessor unit and it is programmed with appropriate software, to interpret the output signal of the threshold detection circuitry 74. The processor 98 sends an alarm signal via the electrical line 88 to the alerting system 76 and the alerting system 76 generates an appropriate alarm to a remote location.

The invention is not limited to the above-described shutter assembly 54. One of ordinary of skill in the art will recognize that there are other approaches. For instance, two polarizers may be used in conjunction with the optical switch 56 to yield an output that is linear with angular movement. When combined with polarization optics, this assembly can also be used as an alterable switch and adjustable attenuator. In another embodiment, the plane of measurement for the movement of the signal lamp could be any one or two of an elevational plane and an azimuthal plane.

Referring back to FIG. 2, the system 20 uses an optical alignment as an external reference. In particular, the system 20 uses an optical sensor assembly 62 that comprises one light source 64, one polarizer 66, an analyzer 68 and a detector 72. The optical sensor assembly 62 is not electrically connected to the signal lamp 10. The light source 64, the analyzer 68 and the detector 72 are affixed mechanically on the coupling fixture 32 of the signal lamp 10 in such a way that the beam axis of the analyzer is vertical and the beam axis passes through the light source 64 and the detector 72. The light source 64, the analyzer 68 and the detector 72 do not move even if the signal lamp 10 moves in any direction. The polarizer 66 is mounted on the signal lamp 10 and affixed to the frame 34 (in FIG. 1) of the signal lamp 10 in such a way that it is inserted in between the light source 64 and the analyzer 68 and its beam axis coincides with the beam axis of the analyzer 68. In this configuration, a ray of light emitted from the light source 64 will pass through the polarizer 66 and then through the analyzer 68 and will be finally detected by the detector 72. Any movement of the signal lamp 10 on an azimuthal or elevational plane moves the polarizer 66 also by the same angle about its own beam axis. The threshold detection circuitry 74 receive the electrical output of the detector 72 and detect whether a preset threshold value of light intensity is exceeded or not. In case the threshold is exceeded, the threshold detection circuitry 74 send a signal to the processor 98. Processor 98 in turn processes the information coming from the threshold detection circuitry 74 and sends a signal to an alerting system 76.

The light source 64 is a light emitting diode and it emits light in all directions. Polarizer 66 is a polarizing beam splitter (PBS) type polarizer and it linearly polarizes the incident unpolarized light coming from signal lamp 10. Polarizer 66 splits the unpolarized light into two components—transmitted component—P-polarized light and reflected component S-polarized light. P-polarized light is light that is parallel to the plane of incidence (which is defined by the incident and reflected rays), while S-polarized light is light that is perpendicular to the plane of incidence. The linear polarizer 66 transmits light polarized in a single plane. Rotating the linear polarizer about its beam axis changes the plane of polarization. The different types of linear polarizers include—dichroic polarizers, dielectric coating (beam splitting) polarizers and calcite crystal polarizers. The important factors considered while selecting the polarizer are cost, wavelength range, aperture size, acceptance angle, damage resistance, transmission efficiency, and extinction ratio. The output polarization axis orientation is independent of the input beam polarization state.

In this embodiment, analyzer 68 receives the transmitted component S-polarized light from the polarizer 66. Analyzer 68 is a polarization-selective device similar to the polarizer 66. Polarizing filters and PBS's are two types of analyzers. The analyzer 68 allows a certain polarization state of the light to pass, while discarding the remaining polarization states. Hence, the analyzer 68 is placed at the output end of the polarizer 66. An observer will not perceive any light unless the analyzer 68 follow the polarizer 66. The analyzer 68 are configured to measure an angular displacement of the polarizer 66. The analyzer 68 could be positioned in different orientations relative to each other. The analyzer 68 could be positioned parallel to each other or perpendicular to each other or at 45 degrees to each other.

In FIG. 2, the detector 72 is positioned at the output end of the analyzer 68 and it is configured to detect an angular displacement of the polarizer 66. In FIG. 2, detector 72 is a phototransistor type light energy detector. A light energy detector converts incident light energy, into electrical signals. The electrical signals produced by such a detector when transmitted to a threshold detection circuitry, can be used to measure whether the intensity of the light incident on the detector exceeds a preset threshold or not.

The invention is not limited to the above-described phototransistor as a detector, though one of the most popular light detectors is the phototransistor. A phototransistor is more sensitive to light than other detectors like PIN diode. Phototransistors are also cheap, readily available and have been used in many published communications circuits. However, most phototransistors will have response times measured in tens of microseconds, which is some 100 times slower than similar PIN diodes. One of ordinary of skill in the art will recognize that there are other approaches for light detection. For instance, detector 72 could be a silicon PIN photodiode, Galium Indium photodiode or an avalanche photodiode or a photo multiplier tube (PMT) or a charge coupled device (CCD).

In operation, the polarizer 66 and the analyzer 68 allow the transmission of only one polarization state. The polarizer 66 polarizes the light coming from the signal lamp 10 and the analyzer 68 transmits that polarized light serially. The intensity of light beam coming out through the analyzer 68 depends on the angular orientation of the analyzer 68 in relation to polarizer 66. The angle between the analyzer 68 and polarizer 66 is predetermined in a particular set up and can range from 0 degree (parallel configuration) to 45 degrees to 90 degrees (perpendicular configuration). The detector 72 detects the intensity of the light beam coming out of the analyzer 68 and correlates the intensity of the light beam with any relative movement between the polarizer 66 and the analyzer 68.

The invention in another embodiment may have more than one analyzer. In another embodiment of this invention, the analyzer may receive the reflected component of the polarized light instead of the transmitted light. The plane of measurement for the angular displacement could be any one or two of an elevational plane and an azimuthal plane. In another embodiment, the light source 64 may be a modulated sight source powered by a square wave voltage. Periodic emission of light from the modulated light source 64 will eliminate any noise factor at the detector 72. For instance, there may be background infrared or solar radiation that may act as noise.

In this embodiment, the threshold detection circuitry 74 make an analog device that communicates with the accelerometer 46, the magnetic sensor 52, the optical switch 56 and the detector 72 via electric lines 84, 82, 78 and 86 respectively. In this embodiment, the threshold detection circuitry 74 receive the signals representative of the elevational movement from the accelerometer 46 and signals representative of the azimuthal movement from the magnetic sensor 52 and the optical switch 56 and the detector 72. In another embodiment, the threshold detection circuitry 74 receive the signals representative of the elevational movement from the magnetic sensor 52 and the optical switch 56 and the detector 72. The threshold detection circuitry 74 determine whether a preset threshold value of motion detection energy is exceeded or not depending on the output signals from the accelerometer 46, the magnetic sensor 52, the shutter 58 and the detector 72. For instance the motion detection energy is light energy in case of the optical switch 56 and the detector 72. On the other hand, the motion detection energy is magnetic energy in case of the accelerometer 46 and the magnetic sensor 52. In particular, the threshold detection circuitry 74 convert the output of the accelerometer 46 or the magnetic sensor 52 or the optical switch 56 or the detector 72 into a measure of the angular displacement of the accelerometer 46, the magnetic sensor 52, the shutter 58 and the polarizer 66 respectively in relation to their original positions. That is also the angle by which the signal lamp 10 has moved.

In case the threshold is exceeded and the signal lamp 10 is sensed to have moved by more than the acceptable limit (such as 4.5 degrees), the threshold detection circuitry 74 send a signal to the processor 98. Processor 98 in turn processes the information coming from the threshold detection circuitry 74 and sends a signal to an alerting system 76. The processor 98 is a microprocessor unit and it is programmed with appropriate software, to interpret the output signal of the threshold detection circuitry 74. The processor 98 sends an alarm signal via the electrical line 88 to the alerting system 76 and the alerting system 76 generates an appropriate alarm to a remote location.

Figure 3:
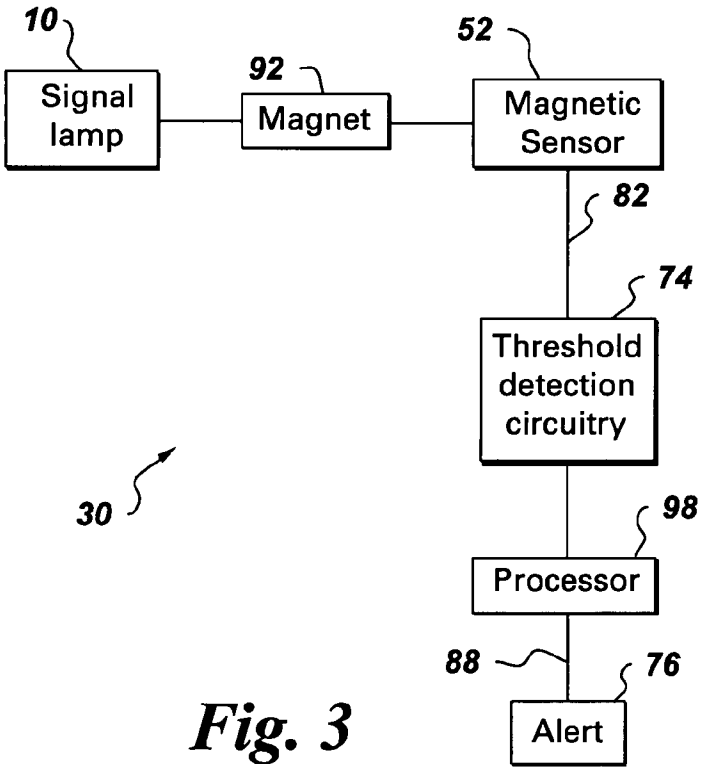
FIG. 3 illustrates the use of a magnet and a magnetic sensor to measure azimuthal or elevational movement of a signal lamp according to one embodiment of the invention.

An alternative to the embodiment described in FIG. 2, is to use a magnet such as a permanent magnet that is movable to at least two locations about the signal lamp. FIG. 3 illustrates a block diagram of a system 30 that uses a permanent magnet 92, a magnetic sensor 52, threshold detection circuitry 74, a processor 98 and an alerting system 76 to measure azimuthal movement of a signal lamp 10 in relation to this reference. The magnetic sensor 52 measures azimuthal movement in relation to the magnetic field reference of the permanent magnet 92. In addition, the magnetic sensor 52 is configured to measure elevational movement of the signal lamp.

Magnet 92 is not connected to the signal lamp 10, but instead is affixed mechanically on the coupling fixture 32 of the signal lamp 10 in such a way that it does not move even if the signal lamp moves in any direction. The magnetic sensor 52 is mounted on the signal lamp 10 and affixed to the hood 38 (in FIG. 1) of the signal lamp 10. The permanent magnet 92 is affixed to the coupling fixture 32 of the signal lamp 10. The permanent magnet 92 is movable to at least two alternative locations. For instance, the permanent magnet 92 could be moved to the top surface of the coupling fixture 32 of the signal lamp 10. It could also be moved to the bottom surface of the coupling fixture 32 of the signal lamp 10. Any movement of the signal lamp 10 on an azimuthal or elevational plane moves the magnetic sensor 52 also by the same amount in the same direction. The threshold detection circuitry 74 sense the resulting change in electrical output of the magnetic sensor 52.

The permanent magnet 92 in this embodiment may be a rare earth magnet e.g. a Neodymium Iron Boron (NdFeB36) magnet of 12,200 Gauss. The magnetic sensor 52 performs a reading at each of the permanent magnet locations, and a comparison of the multiple measurements is performed. Since electronic, temperature and offset drifts (and any other error source that is slowly varying) will affect the multiple measurements equally, a correction is performed to eliminate these errors leaving only the differential/error free part of the measurement. The long-term variations in the output of the magnetic sensor 52 have been noted in laboratory conditions when the sensor 52 is not mechanically attached to the signal lamp 10. The readings show the drift component of the measurements done by means of the magnetic sensor 52. A normalized value of this drift value is applied for correction of the real time measurements. The threshold detection circuitry 74 receive the signals representative of the azimuthal movement from the magnetic sensor 52 and determine a change in alignment of the signal lamp 10 according to the azimuthal movement in the manner described below.

In operation, the permanent magnet 92 is moved to different locations. The movement of the permanent magnet 92 effectively concentrates the magnetic field at different locations. That helps in getting differential measurement of the movement of the signal lamp 10. Moreover, multiple measurements are performed with each of the positions of the permanent magnet 92. The common mode part of the measurement, representing drifts and errors are subtracted leaving the error free differential measurement.

In operation, the magnetic sensor 52 is affixed to the signal lamp 10 and the threshold detection circuitry 74 detect any change in position of the magnetic sensor 52. In this embodiment, the magnetic sensor 52 outputs a signal representative of the azimuthal shift of the signal lamp and sends the signal to the threshold detection circuitry 74 via electrical line 82. In another embodiment, the magnetic sensor 52 outputs a signal representative of the elevational shift of the signal lamp and sends the signal to the threshold detection circuitry 74 via electrical line 82. The threshold detection circuitry 74 make an analog device that determines whether a preset threshold value of magnetic energy is exceeded or not depending on the output signal from the magnetic sensor 52. In particular, the threshold detection circuitry 74 convert the output of the magnetic sensor 52 into a measure of the angular displacement of the magnetic sensor 52 in relation to its original position. That is also the angle by which the signal lamp 10 has moved.

In case the threshold is exceeded and the signal lamp 10 is sensed to have moved by more than the acceptable limit (such as 4.5 degrees), the threshold detection circuitry 74 send a signal to the processor 98. Processor 98 in turn processes the information coming from the threshold detection circuitry 74 and sends a signal to an alerting system 76. The processor 98 is a microprocessor unit and it is programmed with appropriate software, to interpret the output signal of the threshold detection circuitry 74. The processor 98 sends an alarm signal via the electrical line 88 to the alerting system 76 and the alerting system 76 generates an appropriate alarm to a remote location.

The invention in one embodiment may have the permanent magnet 92 stationary. In another embodiment the permanent magnet 92 may also be movable to more that two different locations on the coupling fixture 32 of the signal lamp 10. For instance, the permanent magnet 92 could be moved to the left end of the coupling fixture 32 of the signal lamp 10. It could also be moved to the right end of the coupling fixture 32 of the signal lamp 10. In another embodiment of this invention, the plane of measurement for the angular displacement could be any one or two of an elevational plane and an azimuthal plane.

The invention is not limited to the magnetic field of a local magnet. In another embodiment, the magnetic field of earth can be used as reference. In yet another embodiment, the magnetic field generated from more than one magnet can be used as reference. In another embodiment of this invention, the magnetic sensor 52 may comprise a pair of sensors. In particular, two sensors are used to get a differential measure of the change in position of the signal lamp on a plane of measurement. In another embodiment with two sensors, the differential value is the simple difference between the sensor outputs. In another embodiment, the differential output values from the two sensors are observed and a normalized difference is recorded as the baseline value. The normalized difference is the ratio of the simple difference between the sensor outputs to the total of the two sensor outputs. Use of this metric ensures that any part-to-part variation between the two sensors as well as any error from the change of the strength of the magnet from time to time is accounted for and eliminated. Change in normalized differential output values as compared to the baseline value are monitored so that standard thresholds are not exceeded.

The invention is also not limited to the above-described GMR. Any low magnetic field sensing or field gradient sensing sensor can be used. However, solid-state magnetic field sensors have an inherent advantage in size and power consumption when compared with search coil, flux gate, and more complicated low-field sensing techniques (e.g., superconducting quantum interference detectors [SQUID] and spin resonance magnetometers). For instance, solid-state magnetic sensors like spin dependent tunneling (SDT), spin valve, etc. convert the magnetic field into a voltage or resistance. The sensing can be done in an extremely small, lithographically patterned area, further reducing size and power requirements. The small size of a solid-state element increases the resolution for fields that change over small distances and allows for packaging arrays of sensors in a small enclosure.

Figure 4:
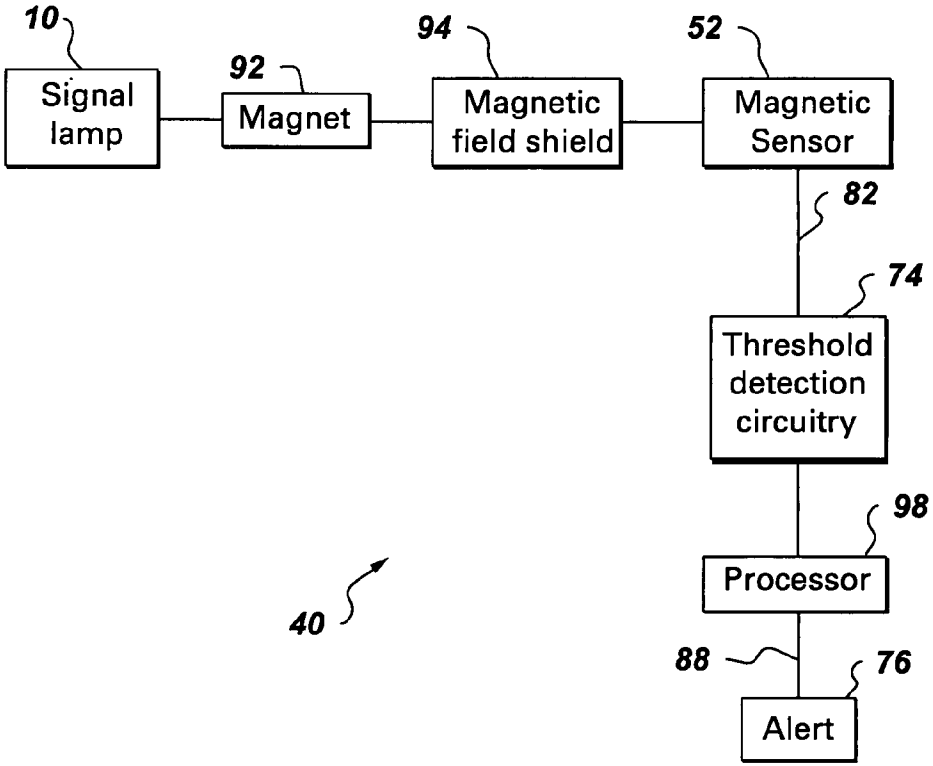
FIG. 4 illustrates the use of a magnet, a magnetic sensor and a magnetic field shield to measure azimuthal or elevational movement of a signal lamp according to one embodiment of the invention.

Another embodiment, as illustrated in FIG. 4, uses a local magnetic field of a stationary permanent magnet as reference. In particular, FIG. 4 shows a block diagram of a system 40 that uses a permanent magnet 92, a magnetic sensor 52, a magnetic field shield 94, threshold detection circuitry 74, a processor 98 and an alerting system 76 to measure azimuthal movement of a signal lamp 10 in relation to this reference. The magnetic sensor 52 measures azimuthal movement in relation to the magnetic field reference of the permanent magnet 92. In addition, the magnetic sensor 52 is configured to measure elevational movement of the signal lamp. A magnetic field shield 94 that is mechanically movable or electrically controlled augments the field strength of the permanent magnet 92. The magnetic field shield 94 is preferably a film type field shield.

Magnet 92 and magnetic field shield 94 are not connected to the signal lamp 10. Magnet 92 and magnetic field shield 94 are affixed mechanically on the coupling fixture 32 of the signal lamp 10 in such a way that they do not move even if the signal lamp 10 moves in any direction. The magnetic sensor 52 is mounted on the signal lamp 10 and affixed to the hood 38 (in FIG. 1) of the signal lamp 10. The permanent magnet 92 is affixed to the coupling fixture 32 of the signal lamp 10. The magnetic field shield 94 is also affixed to the coupling fixture 32 of the signal lamp 10. The permanent magnet 92 is always stationary but the magnetic field shield 94 is movable by mechanical means and controllable electrically. Any movement of the signal lamp 10 on an azimuthal or elevational plane moves the magnetic sensor 52 also by the same amount in the same direction. The threshold detection circuitry 74 sense resulting change in electrical output of the magnetic sensor 52.

Magnetic field shield 94 is made of specific materials in the form of enclosures or barriers to reduce magnetic field levels in a region of space. In case of magnetic field shield 94, shield material preferably has significant permeability. This material attribute corresponds to the basic magnetic field shielding achieved by means of flux shunting. Magnetization in the shield material depends on the overall source-shield configuration. Both the region where shielding is achieved and the amount by which the field is reduced over this region depend on multiple factors like the source geometry and orientation, source magnitude, shield geometry, shield composition, location of the shield and source that is capable of suppressing electromagnetic field leakage easily and at low cost.

The magnetic field shield 94 gathers magnetic flux of the magnet 92 to form a magnetic passage. Since an aggregate of magnetic particles is used as the magnetic field shield 94 in the embodiment, the magnetic field shield 94 can be easily molded into various shapes and can be easily manufactured. Preferably, the magnetic particles in the magnetic field shield 94 of the invention include at least one of iron powder, ferrite powder, and magnetite powder. The face of the magnetic field shield 94 opposed to the magnet 92 is shaped like a curved surface to surround the magnet 92 so as to make it possible to effectively shield any leakage. However, the shape of the magnetic field shield 94 is not limited to the shape of a curved surface. Any shape of a flat plate, a box, angular U, a dome, or a combination thereof can be selected.

In operation, the magnetic field shield 94 is used to shield and unshield the magnetic field of the permanent magnet 92 alternately. Moreover, the magnetic field shield 94 is also moved to different locations in relation to the permanent magnet 92. For instance, the magnetic field shield 94 can be positioned towards left of the center of 18 (FIG. 1) of the face of the signal lamp. As an alternative, the magnetic field shield 94 can be positioned towards left of the center of 18 (FIG. 1) of the face of the signal lamp. Alteration between shielding and unshielding mode of the magnetic field shield 94 helps getting differential measurement of the movement of the signal lamp 10. The movement of the magnetic field shield 94 effectively concentrates the magnetic field at different locations even though the permanent magnet 92 remains stationary. That also helps in getting differential measurement of the movement of the signal lamp 10. Moreover, multiple measurements are performed with each of the positions of the magnetic field shield 94 in relation to the stationary permanent magnet 92. The common mode part of the measurement, representing drifts and errors are subtracted leaving the error free differential measurement.

In operation, the magnetic sensor 52 is affixed to the signal lamp 10 and the threshold detection circuitry 74 detect any change in position of the magnetic sensor 52. In this embodiment, the magnetic sensor 52 outputs a signal representative of the azimuthal shift of the signal lamp and sends the signal to the threshold detection circuitry 74 via electrical line 82. In another embodiment, the magnetic sensor 52 outputs a signal representative of the elevational shift of the signal lamp and sends the signal to the threshold detection circuitry 74 via electrical line 82. The threshold detection circuitry 74 make an analog device that determines whether a preset threshold value of magnetic energy is exceeded or not depending on the output signal from the magnetic sensor 52. In particular, the threshold detection circuitry 74 convert the output of the magnetic sensor 52 into a measure of the angular displacement of the magnetic sensor 52 in relation to its original position. That is also the angle by which the signal lamp 10 has moved.

In case the threshold is exceeded and the signal lamp 10 is sensed to have moved by more than the acceptable limit (such as 4.5 degrees), the threshold detection circuitry 74 send a signal to the processor 98. Processor 98 in turn processes the information coming from the threshold detection circuitry 74 and sends a signal to an alerting system 76. The processor 98 is a microprocessor unit and it is programmed with appropriate software, to interpret the output signal of the threshold detection circuitry 74. The processor 98 sends an alarm signal via the electrical line 88 to the alerting system 76 and the alerting system 76 generates an appropriate alarm to a remote location.

The invention in another embodiment may have the permanent magnet 92 also movable to different locations on the coupling fixture 32 of the signal lamp 10. For instance, the permanent magnet 92 could be moved to the top surface of the coupling fixture 32 of the signal lamp 10. It could also be moved to the bottom surface of the coupling fixture 32 of the signal lamp 10. In another embodiment of this invention, the plane of measurement for the angular displacement could be any one or two of an elevational plane and an azimuthal plane.

Figure 5:
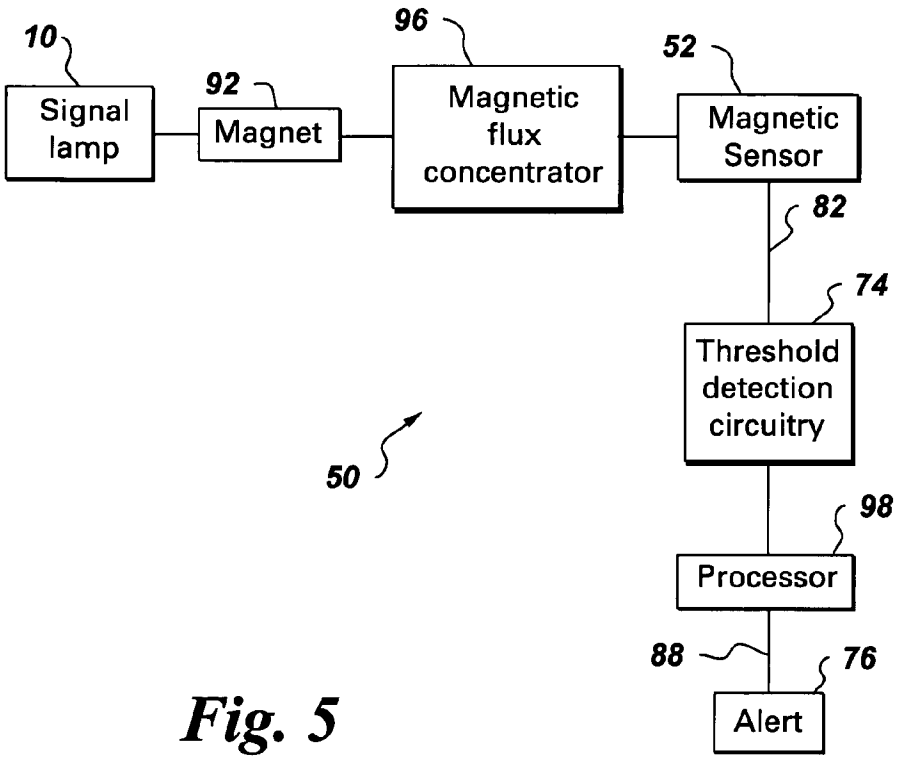
FIG. 5 illustrates the use of a magnet, a magnetic sensor and a magnetic flux concentrator to measure azimuthal or elevational movement of a signal lamp according to one embodiment of the invention.

Another embodiment where a local magnetic field of a stationary permanent magnet 92 is used as a reference is disclosed in FIG. 5. In particular, FIG. 5 shows a block diagram of a system 50 that uses a permanent magnet 92, a magnetic sensor 52, a magnetic flux concentrator 96, threshold detection circuitry 74, a processor 98 and an alerting system 76 to measure azimuthal movement of a signal lamp 10 in relation to this reference. The magnetic sensor 52 measures azimuthal movement in relation to the magnetic field reference of the permanent magnet 92. In addition, the magnetic sensor 52 is configured to measure elevational movement of the signal lamp. A magnetic flux concentrator 96 that is mechanically movable or electrically controlled augments the field strength of the permanent magnet 92.

Magnet 92 and magnetic flux concentrator 96 are not connected to the signal lamp 10. Magnet 92 and magnetic flux concentrator 96 are affixed mechanically on the coupling fixture 32 of the signal lamp 10 in such a way that they do not move even if the signal lamp 10 moves in any direction. The magnetic sensor 52 is mounted on the signal lamp 10 and affixed to the hood 38 (in FIG. 1) of the signal lamp 10. The permanent magnet 92 is affixed to the coupling fixture 32 of the signal lamp 10. The magnetic flux concentrator 96 is also affixed to the coupling fixture 32 of the signal lamp 10. The permanent magnet 92 is always stationary but the magnetic flux concentrator 96 is movable by mechanical means and controllable electrically. Any movement of the signal lamp 10 on an azimuthal or elevational plane moves the magnetic sensor 52 also by the same amount in the same direction. The threshold detection circuitry 74 sense resulting change in electrical output of the magnetic sensor 52.

The magnetic flux concentrator 96 is made of material like permalloy or some other material with high permeability. For example, permalloy-78, after annealing, has a permeability of about 8000 at B=20 Gauss up to 100,000 Gauss/Oested. The concentrated magnetic field is a function of the distance to a device, is sensed by the sensing chip. The magnetic flux concentrator 96 also makes the magnetic flux more uniform, thus improving inconsistencies in magnets and improving the overall response. For a typical fixed magnet 92, there is some point of maximum flux at the surface of the magnet 92. This point is difficult to control, however, and can vary from one permanent magnet to another due to impurities in the magnets. The improvement in uniformity is especially important when a small magnet is used with a chip that has sensing cells on opposite sides of a chip, and particularly when a fine level of precision is required In operation, the magnetic flux concentrator 96 is moved to different locations in relation to the permanent magnet 92. For instance, the magnetic flux concentrator 96 can be positioned towards left of the center of 18 (FIG. 1) of the face of the signal lamp. As an alternative, the magnetic flux concentrator 96 can be positioned towards left of the center of 18 (FIG. 1) of the face of the signal lamp. The movement of the magnetic flux concentrator 96 effectively concentrates the magnetic field at different locations even though the permanent magnet 92 remains stationary. That helps in getting differential measurement of the movement of the signal lamp 10. Moreover, multiple measurements are performed with each of the positions of the magnetic flux concentrator 96 in relation to the stationary permanent magnet 92. The common mode part of the measurement, representing drifts and errors are subtracted leaving the error free differential measurement.

In operation, the magnetic sensor 52 is affixed to the signal lamp 10 and the threshold detection circuitry 74 detect any change in position of the magnetic sensor 52. In this embodiment, the magnetic sensor 52 outputs a signal representative of the azimuthal shift of the signal lamp and sends the signal to the threshold detection circuitry 74 via electrical line 82. In another embodiment, the magnetic sensor 52 outputs a signal representative of the elevational shift of the signal lamp and sends the signal to the threshold detection circuitry 74 via electrical line 82. The threshold detection circuitry 74 make an analog device that determines whether a preset threshold value of magnetic energy is exceeded or not depending on the output signal from the magnetic sensor 52. In particular, the threshold detection circuitry 74 convert the output of the magnetic sensor 52 into a measure of the angular displacement of the magnetic sensor 52 in relation to its original position. That is also the angle by which the signal lamp 10 has moved.

In case the threshold is exceeded and the signal lamp 10 is sensed to have moved by more than the acceptable limit (such as 4.5 degrees), the threshold detection circuitry 74 send a signal to the processor 98. Processor 98 in turn processes the information coming from the threshold detection circuitry 74 and sends a signal to an alerting system 76. The processor 98 is a microprocessor unit and it is programmed with appropriate software, to interpret the output signal of the threshold detection circuitry 74. The processor 98 sends an alarm signal via the electrical line 88 to the alerting system 76 and the alerting system 76 generates an appropriate alarm to a remote location.

The invention in another embodiment may have the permanent magnet 92 also movable to different locations on the coupling fixture 32 of the signal lamp 10. For instance, the permanent magnet 92 could be moved to the top surface of the coupling fixture 32 of the signal lamp 10. It could also be moved to the bottom surface of the coupling fixture 32 of the signal lamp 10. In another embodiment of this invention, the plane of measurement for the angular displacement could be any one or two of an elevational plane and an azimuthal plane.

Figure 6:
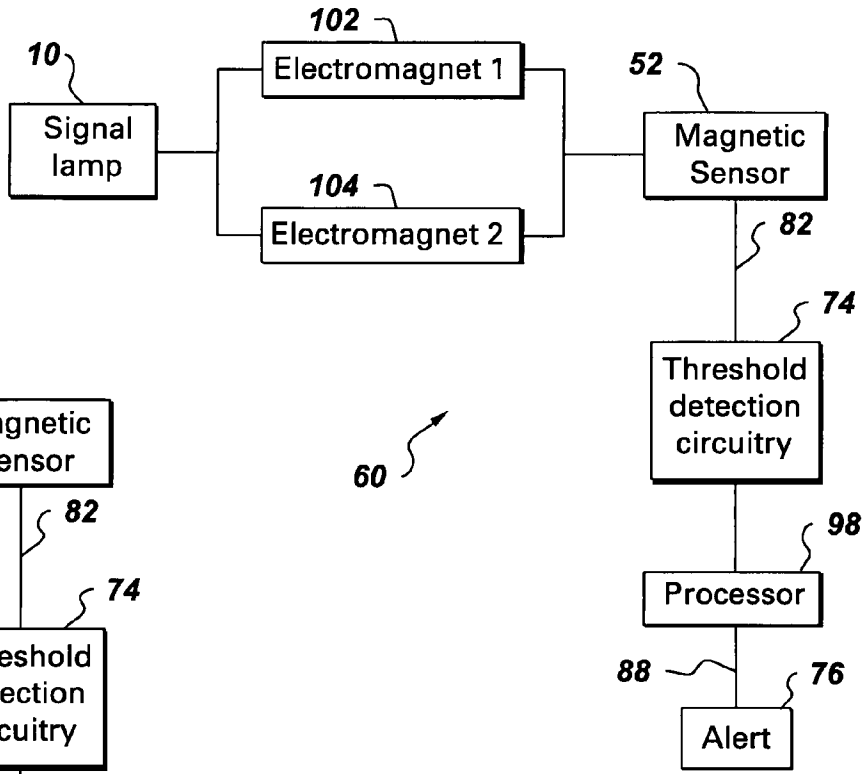
FIG. 6 illustrates the use of two electromagnets and a magnetic sensor to measure azimuthal or elevational movement of a signal lamp according to one embodiment of the invention.

Another embodiment as illustrated in FIG. 6 has a local magnetic field of two stationary electromagnets as reference. In particular, FIG. 6 shows a block diagram of a system 60 that uses stationary electromagnets 102 and 104, a magnetic sensor 52, threshold detection circuitry 74 and an alerting system 76 to measure azimuthal movement in relation this reference. In addition, the magnetic sensor 52 in this embodiment is configured to measure elevational movement of the signal lamp.

The two electromagnets 102 and 104 are not connected to the signal lamp 10, but instead are affixed mechanically on the coupling fixture 32 of the signal lamp 10 in such a way that they do not move even if the signal lamp 10 moves in any direction. The magnetic sensor 52 is mounted on the signal lamp 10 and affixed to the hood 38 (in FIG. 1) of the signal lamp 10. The two electromagnets 102 and 104 are affixed to the coupling fixture 32 of the signal lamp 10. The two electromagnets 102 and 104 are stationary. Any movement of the signal lamp 10 on an azimuthal or elevational plane moves the magnetic sensor 52 also by the same amount in the same direction. The threshold detection circuitry 74 sense resulting change in electrical output of the magnetic sensor 52.

In operation, the two electromagnets 102 and 104 are alternately energized and de-energized. The two electromagnets 102 and 104 are used alternately in order to get differential measurement of the movement of the signal lamp 10. Moreover, multiple measurements are performed with each of the two electromagnets 102 and 104 energized. Measurements are repeated with the other magnet in the same fashion. The common mode part of the measurement, representing drifts and errors are subtracted leaving the error free differential measurement.

In operation, the magnetic sensor 52 is affixed to the signal lamp 10 and the threshold detection circuitry 74 detect any change in position of the magnetic sensor 52. In this embodiment, the magnetic sensor 52 outputs a signal representative of the azimuthal shift of the signal lamp and sends the signal to the threshold detection circuitry 74 via electrical line 82. In another embodiment, the magnetic sensor 52 outputs a signal representative of the elevational shift of the signal lamp and sends the signal to the threshold detection circuitry 74 via electrical line 82. The threshold detection circuitry 74 make an analog device that determines whether a preset threshold value of magnetic energy is exceeded or not depending on the output signal from the magnetic sensor 52. In particular, the threshold detection circuitry 74 convert the output of the magnetic sensor 52 into a measure of the angular displacement of the magnetic sensor 52 in relation to its original position. That is also the angle by which the signal lamp 10 has moved.

In case the threshold is exceeded and the signal lamp 10 is sensed to have moved by more than the acceptable limit (such as 4.5 degrees), the threshold detection circuitry 74 send a signal to the processor 98. Processor 98 in turn processes the information coming from the threshold detection circuitry 74 and sends a signal to an alerting system 76. The processor 98 is a microprocessor unit and it is programmed with appropriate software, to interpret the output signal of the threshold detection circuitry 74. The processor 98 sends an alarm signal via the electrical line 88 to the alerting system 76 and the alerting system 76 generates an appropriate alarm to a remote location.

The invention in another embodiment may have only one electromagnet. It may also have more than two electromagnets. In another embodiment of this invention, the plane of measurement for the angular displacement could be any one or two of an elevational plane and an azimuthal plane.

Figure 7:
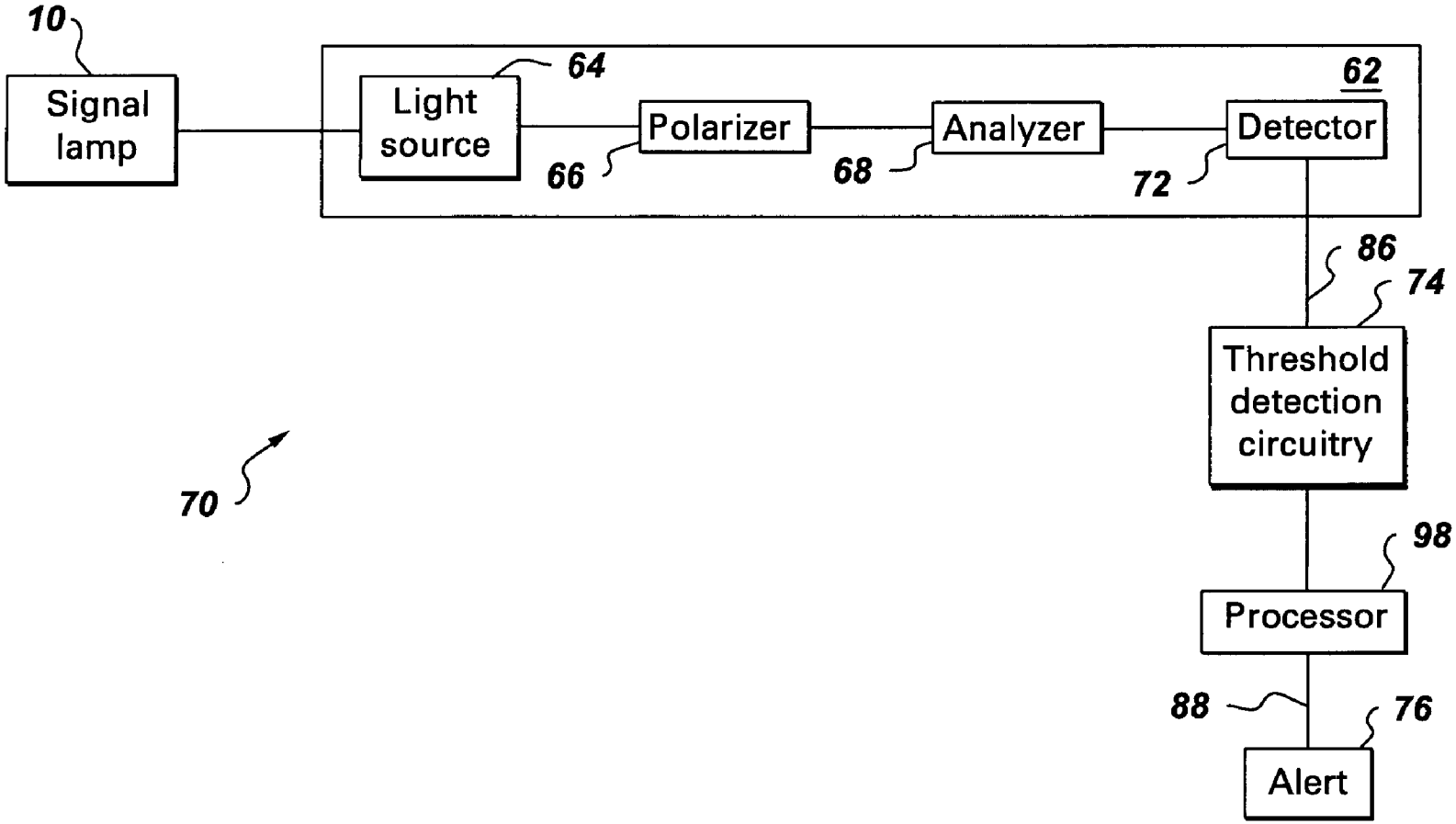
FIG. 7 illustrates the use of a light source, a polarizer, an analyzer and a detector to measure azimuthal or elevational movement of a signal lamp according to one embodiment of the invention.

Another embodiment, as illustrated in FIG. 7 has an optical alignment as external reference. In particular, FIG. 7 shows a block diagram of a system 70 that comprises a signal lamp 10, an optical sensor assembly 62, threshold detection circuitry 74, a processor 98 and an alerting system 76. The optical sensor assembly 62 is configured to measure azimuthal movement of the signal lamp 10. In addition, the optical sensor 62 assembly is configured to measure elevational movement of the signal lamp. The optical sensor assembly 62 comprises a light source 64, a polarizer 66, an analyzer 66 and a detector 72.

The optical sensor assembly 62 is not electrically connected to the signal lamp 10. The light source 64, the analyzer 68 and the detector 72 are affixed mechanically on the coupling fixture 32 of the signal lamp 10 in such a way that the beam axis of the analyzer is vertical and the beam axis passes through the light source 64 and the detector 72. The light source 64, the analyzer 68 and the detector 72 do not move even if the signal lamp 10 moves in any direction. The polarizer 66 is mounted on the signal lamp 10 and affixed to the frame 34 (in FIG. 1) of the signal lamp 10 in such a way that it is inserted in between the light source 64 and the analyzer 68 and its beam axis coincides with the beam axis of the analyzer 68. In this configuration, a ray of light emitted from the light source 64 will pass through the polarizer 66 and then through the analyzer 68 and will be finally detected by the detector 72. Any movement of the signal lamp 10 on an azimuthal or elevational plane moves the polarizer 66 also by the same angle about its own beam axis. The threshold detection circuitry 74 receive the electrical output of the detector 72 and detects whether a preset threshold value of light intensity is exceeded or not. In case the threshold is exceeded, the threshold detection circuitry 74 send a signal to the processor 98. Processor 98 in turn processes the information coming from the threshold detection circuitry 74 and sends a signal to an alerting system 76.

The light source 64 is a light emitting diode and it emits light in all directions. Polarizer 66 is a polarizing beam splitter (PBS) type polarizer and it linearly polarizes the incident unpolarized light coming from signal lamp 10. Polarizer 66 splits the unpolarized light into two components—transmitted component—P-polarized light and reflected component S-polarized light. P-polarized light is light that is parallel to the plane of incidence (which is defined by the incident and reflected rays), while S-polarized light is light that is perpendicular to the plane of incidence. The linear polarizer 66 transmits light polarized in a single plane. Rotating the linear polarizer about its beam axis changes the plane of polarization. The different types of linear polarizers include—dichroic polarizers, dielectric coating (beam splitting) polarizers and calcite crystal polarizers. The important factors considered while selecting the polarizer are cost, wavelength range, aperture size, acceptance angle, damage resistance, transmission efficiency, and extinction ratio. The output polarization axis orientation is independent of the input beam polarization state.

In this embodiment, analyzer 68 receives the transmitted component S-polarized light from the polarizer 66. Analyzer 68 is a polarization-selective device similar to the polarizer 66. Polarizing filters and PBS's are two types of analyzers. The analyzer 68 allows a certain polarization state of the light to pass, while discarding the remaining polarization states. Hence, the analyzer 68 is placed at the output end of the polarizer 66. An observer will not perceive any light unless the analyzer 68 follow the polarizer 66. The analyzer 68 are configured to measure an angular displacement of the polarizer 66. The analyzer 68 could be positioned in different orientations relative to each other. The analyzer 68 could be positioned parallel to each other or perpendicular to each other or at 45 degree to each other.

In FIG. 7, the detector 72 is positioned at the output end of the analyzer 68 and it is configured to detect an angular displacement of the polarizer 66. In FIG. 7, detector 72 is a phototransistor type light energy detector. A light energy detector converts incident light energy, into electrical signals. The electrical signals produced by such a detector when transmitted to a threshold detection circuitry, can be used to measure whether the intensity of the light incident on the detector exceeds a preset threshold or not.

In operation, the polarizer 66 and the analyzer 68 allow the transmission of only one polarization state. The polarizer 66 polarizes the light coming from the signal lamp 10 and the analyzer 68 transmits that polarized light serially. The intensity of light beam coming out through the analyzer 68 depends on the angular orientation of the analyzer 68 in relation to polarizer 66. The angle between the analyzer 68 and polarizer 66 is predetermined in a particular set up and can range from 0 degree (parallel configuration) to 45 degrees to 90 degrees (perpendicular configuration). The detector 72 detects the intensity of the light beam coming out of the analyzer 68 and correlates the intensity of the light beam with any relative movement between the polarizer 66 and the analyzer 68.

In this embodiment, the threshold detection circuitry 74 receive the signals representative of the azimuthal movement from the detector 72. In another embodiment, the threshold detection circuitry 74 receive the signals representative of the elevational movement from the detector 72. The threshold detection circuitry 74 make an analog device that is in communication with the detector 72. The detector outputs a signal representative of the intensity of the light energy coming out of the polarizer and transmitted through the analyzer. The detector is electrically connected to the threshold detection circuitry 74 and its output signal is transmitted to the threshold detection circuitry 74 via electrical line 86. The threshold detection circuitry 74 detect whether a preset threshold value of light intensity is exceeded or not. In particular, the threshold detection circuitry 74 convert the output of the detector 72 into a measure of the angular displacement of the polarizer 66 in relation to its original position. That is also the angle by which the signal lamp 10 has moved.

In case the threshold is exceeded and the signal lamp 10 is sensed to have moved by more than the acceptable limit (such as 4.5 degrees), the threshold detection circuitry 74 send a signal to the processor 98. Processor 98 in turn processes the information coming from the threshold detection circuitry 74 and sends a signal to an alerting system 76. The processor 98 is a microprocessor unit and it is programmed with appropriate software, to interpret the output signal of the threshold detection circuitry 74. The processor 98 sends an alarm signal via the electrical line 88 to the alerting system 76 and the alerting system 76 generates an appropriate alarm to a remote location.

The invention in another embodiment may have more than one analyzer. In another embodiment of this invention, the analyzer may receive the reflected component of the polarized light instead of the transmitted light. The plane of measurement for the angular displacement could be any one or two of an elevational plane and an azimuthal plane. In another embodiment, the light source 64 may be a modulated sight source powered by a square wave voltage. Periodic emission from the modulated light source 64 will eliminate any noise factor at the detector 72. For instance, there may be background infrared or solar radiation that may act as noise.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A system for monitoring alignment of a signal lamp, comprising:

at least one sensor, positioned about the signal lamp and configured to measure at least one of azimuthal and elevational movement of the signal lamp and generate an electrical signal; and threshold detection circuitry, configured to receive signals representative of the azimuthal and elevational movement of the signal lamp from said at least one sensor, wherein said threshold detection circuitry determine a change in alignment of the signal lamp according to at least one of the azimuthal and the elevational movement signals.

2. The system according to claim 1, wherein said at least one sensor is an accelerometer configured to measure said elevational movement of the signal lamp and generate said electrical signal.

3. The system according to claim 1, wherein said at least one sensor comprises at least one magnetic sensor configured to measure at least one of said azimuthal and elevational movement of the signal lamp in relation to a predetermined magnetic field reference and generate said electrical signal.

4. The system according to claim 3, wherein said at least one magnetic sensor comprises two magnetic sensors configured to generate two outputs indicative of said movement of the signal lamp.

5. The system according to claim 3, wherein a difference between said two outputs from said two magnetic sensors indicate said movement of the signal lamp.

6. The system according to claim 3, wherein a normalized difference between said two outputs from said two magnetic sensors indicate said movement of the signal lamp.

7. The system according to claim 3, wherein said predetermined magnetic field comprises the magnetic field of earth.

8. The system according to claim 3, wherein said predetermined magnetic field comprises a magnetic field of at least one local magnet.

9. The system according to claim 8, further comprising a magnetic field shield, disposed about said at least one local magnet and configured to shield and unshield the spatial distribution of a magnetic field generated from said at least one local magnet.

10. The system according to claim 8, further comprising a magnetic flux concentrator disposed about said at least one local magnet and configured to focus the spatial distribution on of a magnetic field generated from said at least one local magnet.

11. The system according to claim 8, wherein said at least one local magnet comprises at least two local magnets, each positioned about the signal lamp.

12. The system according to claim 3 wherein said at least one magnetic sensor is a magneto resistive sensor.

13. The system according to claim 1 wherein said at least one sensor is an optical sensor assembly configured to measure said at least one of azimuthal and elevational movement of the signal lamp and generate said electrical signal.

14. The system according to claim 13, further comprising at least one light source, a polarizer disposed about the lamp at a predetermined distance therefrom and at least one analyzer disposed about said polarizer and configured to measure a change in angular displacement of said polarizer; and at least one detector disposed about said at least one analyzer and configured to detect an occurrence of the angular displacement.

15. The system according to claim 1, wherein said threshold detection circuitry are configured to determine change in alignment of said signal lamp to about plus or minus 4.5 degrees on at least one of azimuthal and elevational plane.

16. The system according to claim 1, wherein said threshold detection circuitry further comprises a processor and an alerting system, wherein said processor is configured to send an alarm signal to said alerting system when there is a determined change in alignment.

17. The system according to claim 1, wherein said at least one sensor is a shutter assembly positioned about the signal lamp and configured to measure at least one of azimuthal and elevational movement of the signal lamp, wherein said shutter assembly comprises an optical switch and a shutter located at a predetermined distance from said optical switch.

18. The system according to claim 17, wherein said threshold detection circuitry are configured to receive signals representative of at least one of the azimuthal and elevational movement of the signal lamp from said shutter assembly.

19. A method of monitoring alignment of a signal lamp, comprising:

positioning at least one sensor about the signal lamp;

configuring said at least one sensor to measure at least one of azimuthal and elevational movement of the signal lamp and generate an electrical signal;

receiving at least one of signals representative of azimuthal and elevational movement of the signal lamp from said sensor; and determining a change in alignment of the signal lamp according to at least one of signals representative of azimuthal and elevational movement of the signal lamp.

20. The method according to claim 19, wherein configuring said at least one sensor further comprising configuring said at least one sensor as an accelerometer to measure said elevational movement of the signal lamp and generate said electrical signal.

21. The method according to claim 19, wherein configuring said at least one sensor further comprising configuring said at least one sensor as at least one magnetic sensor to measure said at least one of azimuthal and elevational movement of the signal lamp in relation to a predetermined magnetic field reference and generate said electrical signal.

22. The method according to claim 21, wherein configuring said at least one magnetic sensor further comprising configuring said at least one magnetic sensor as at least two magnetic sensors to generate two outputs indicative of said movement of the signal lamp.

23. The method according to claim 22, wherein configuring said at least two magnetic sensors further comprising measuring said movement of the signal lamp based on a difference between said two outputs of said two magnetic sensors.

24. The method according to claim 22, wherein configuring said at least two magnetic sensors further comprising measuring said movement of the signal lamp based on a normalized difference between said two outputs of said two magnetic sensors.

25. The method according to claim 21, wherein said predetermined magnetic field comprises the magnetic field of earth.

26. The method according to claim 21 ,wherein said predetermined magnetic field comprises a magnetic field of at least one local magnet.

27. The method according to claim 26, wherein said magnetic field of at least one local magnet further comprises a magnetic field of at least two magnets.

28. The method according to claim 27, wherein said magnetic field of at least two magnets further comprising a magnetic field of two electromagnets.

29. The method according to claim 28, further comprising energizing and de-energizing said magnetic field of said two electromagnets alternately.

30. The method according to claim 26, further comprising positioning a magnetic field shield, disposed about said at least one local magnet and configuring said magnetic field shield to shield and unshield the spatial distribution of said magnetic field generated from said at least one local magnet.

31. The method according to claim 26, further comprising positioning a magnetic flux concentrator disposed about said at least one local magnet and configuring said magnetic flux concentrator to focus the spatial distribution of said magnetic field generated from said at least one local magnet.

32. The method according to claim 19, wherein configuring said at least one sensor further comprising configuring said at least one sensor as an optical sensor assembly.

33. The method according to claim 32, wherein configuring said optical sensor assembly farther comprising positioning at least one polarizer coupled to the signal lamp at a predetermined distance therefrom and at least one analyzer coupled to said at least one polarizer and at least one detector coupled to said at least one analyzer and configuring said at least one analyzer to measure a change in a predetermined parameter with respect to said polarizer and configuring said detector to detect an occurrence of said predetermined parameter with respect to said polarizer, wherein the predetermined parameter is an angular displacement of said polarizer.

34. The method according to claim 33, further comprising configuring said at least one polarizer as a linear polarizer.

35. The method according to claim 19, further comprising generating an alert to a remote location when a change in alignment is determined.

36. The method according to claim 19, further comprising positioning a shutter assembly about the signal lamp and configuring said shutter to measure at least one of azimuthal or elevational movement of the signal lamp.

37. The method according to claim 36, wherein said receiving at least one of signals representative of the azimuthal or elevational movement of the signal lamp further comprising receiving signals from said shutter assembly.

* * * * *